US005536080A

United States Patent [19]

Madimenos et al.

[11] Patent Number: 5,536,080

[45] Date of Patent: Jul. 16, 1996

[54] FREE STANDING WORK STATION

[75] Inventors: Peter Madimenos; Corrine Madimenos, both of Chicago, Ill.

[73] Assignee: atelier ADIME Internationale, Inc., Chicago, Ill.

[21] Appl. No.: 324,223

[22] Filed: Oct. 14, 1994

[51] Int. Cl.[6] ..... A47B 88/00

[52] U.S. Cl. ..... 312/317.1; 312/140.1; 312/239; 312/196; 312/249.9; 312/197; 312/298; 108/38; 108/41; 108/94; 108/103

[58] Field of Search ..... 312/317.1, 194, 312/196, 197, 239, 249.9, 321, 315, 200, 204, 309; 108/33, 35, 38, 94, 103, 41

[56] References Cited

U.S. PATENT DOCUMENTS

| | | | |
|---|---|---|---|
| 258,604 | 5/1882 | Richardson | 312/200 |
| 1,269,225 | 6/1918 | Sciannamea | 312/204 X |
| 1,348,073 | 7/1920 | Almy | 312/200 |
| 2,643,167 | 6/1953 | Wade | 312/239 X |
| 2,988,413 | 6/1961 | Bergen | 108/94 X |
| 3,070,416 | 12/1962 | Post | 108/41 X |
| 3,078,133 | 2/1963 | Schauer | 312/309 X |
| 3,936,110 | 2/1976 | Meggs et al. | 108/38 X |
| 4,258,963 | 3/1981 | Fusselman et al. | 312/196 X |
| 4,938,364 | 7/1990 | Stadelman et al. | 108/103 X |
| 5,005,925 | 4/1991 | Diehl | 108/38 X |
| 5,020,867 | 6/1991 | McManus | 312/239 X |
| 5,403,082 | 4/1995 | Kramer | 312/249.9 |

FOREIGN PATENT DOCUMENTS

| | | | |
|---|---|---|---|
| 1176839 | 4/1959 | France | 312/140.1 |

OTHER PUBLICATIONS

Brochure entitled "Clipper/CS—1" from New Space, Inc. (A Division of Gilbert International, Inc.), ©1994 [Known to Applicants in Apr. 1993].

Brochure entitled "Sligh" , from Homeworks.

*Primary Examiner*—Jose V. Chen

*Assistant Examiner*—Rodney B. White

*Attorney, Agent, or Firm*—Wallenstein & Wagner, Ltd.

[57] ABSTRACT

A work station (10) for use in a home, office, hotel or other area having a limited amount of space is disclosed. The unit (10) includes sections (12,14,16) movable between a closed position, wherein the unit looks like an armoire or entertainment cabinet, and an open position, wherein the unit is a complete work station with a desk top (24,26) and storage space (22,23,30) for a computer, printer, phone, chair, fax machine and files.

16 Claims, 9 Drawing Sheets

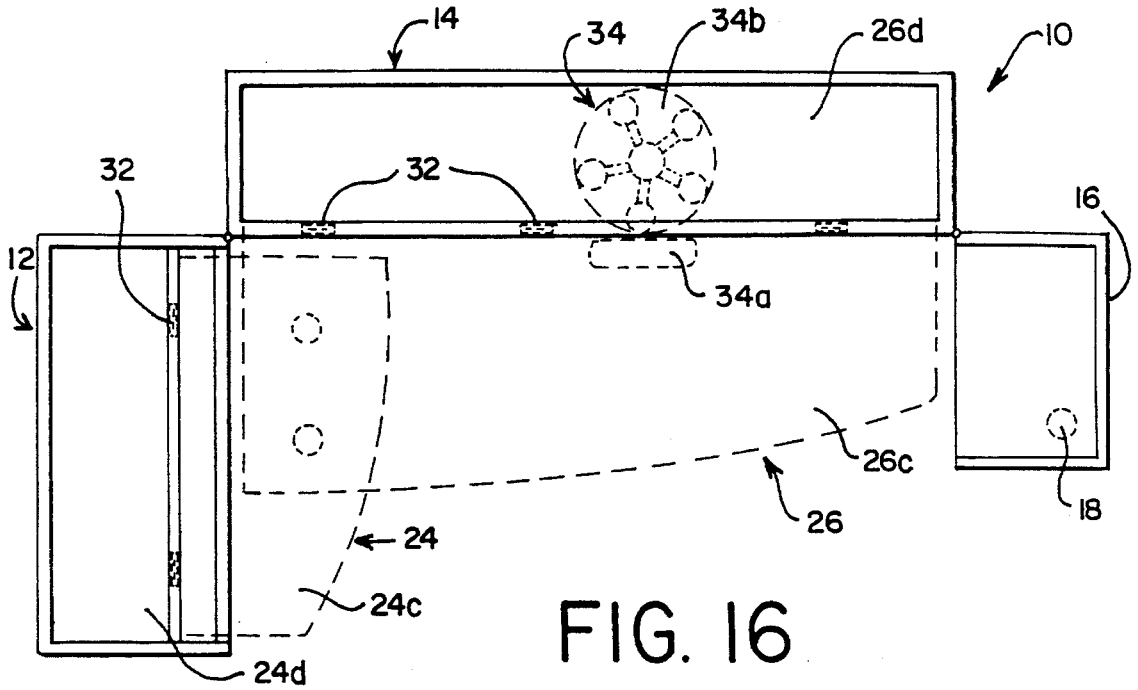
FIG. 16
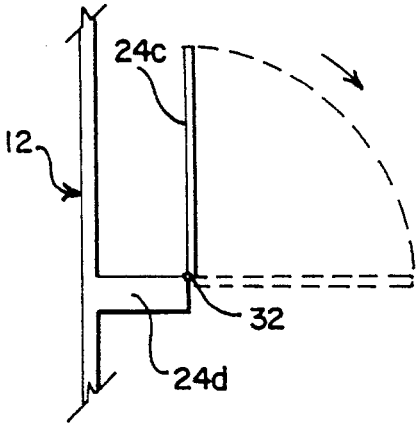
FIG. 17
FIG. 18
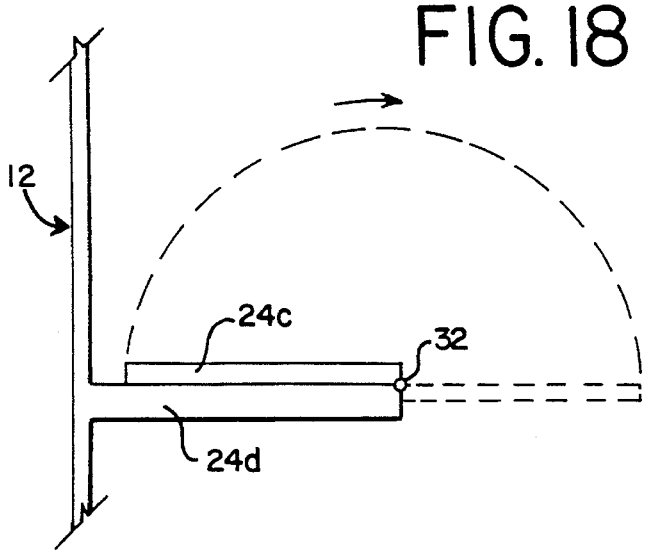

FREE STANDING WORK STATION

TECHNICAL BACKGROUND

This invention relates to a self-contained, free standing work station, and more particularly, to a single unit for use at home, office or hotel having sections movable between an open position (wherein the unit is a complete work station with a desk top and space for a computer, printer, phone, chair, fax machine and files) and a closed position (wherein the unit looks like an armoire or entertainment cabinet).

BACKGROUND OF THE INVENTION

In recent years, many product lines and manufacturers of furniture have been directed to designs that are practical and useful on the one hand and aesthetically pleasing on the other hand. Examples include the variations of the old rolltop or folding-top desk and the more modern combination television and stereo cabinet found in many of today's living rooms. Specifically, a cabinet may look from the outside to be an antique dressing cabinet or bureau, but house internally an entertainment system of audio and visual equipment. These designs have proven to be practical in homes with few or small rooms and for homeowners preferring a less cluttered, more organized, and aesthetically pleasing appearance. In addition, due to limited space availability, such pieces are used in hotel rooms today. Small office spaces also require a compact and organized arrangement of furniture and work space. Further, because of the proliferation of home offices, there is a tremendous need for furniture units to include many components, such as desk or work surfaces, file drawers, a computer, a printer, a telephone, and a fax machine. To date, units accommodating such office equipment generally comprise a desk and a shelving unit or cupboard above the desk. A possible side cart or table may also hold a printer and its paper. To ensure compactness, these units tend to have very little horizontal space or depth, rather, they include substantial vertical components, like those just discussed.

Consequently, there is a need for furniture that is both pleasing to the eye in a room not intended to be an office and can be converted or transformed into a fully organized and equipped office.

The present invention provides a single unit that can be opened and closed. In the open position, the sections provide an expansive work surface easily usable as a desk top, ample room for file storage, places for immediate access to a computer, printer, telephone and fax machine. A chair is also easily stored within the unit. In the closed position, the unit appears like an armoire and may be finished or contoured to replicate any style, i.e., modern, art deco, arts and crafts, prairie, victorian, edwardian, asian (oriental), etc.

SUMMARY OF THE INVENTION

The invention provides a single unit, freestanding work station having a front section and a rear section, with one section movable between an open and a closed position. Each section includes a horizontally positioned, inwardly projecting work surface. The work surfaces are adapted to fit within the work station when one section is in a closed position. The work surfaces cooperate to form an expanding work surface, having a surface area greater than either work surface alone when one section is in an open position.

Additionally, in one embodiment of the invention, when the work station is in a closed position, the work surfaces overlap completely in a first overlapping position. In an alternative embodiment of the invention, when the work station is in a closed position, the work surfaces fold either upright from a horizontal position into a vertical position for storage within the work station, or back onto themselves for compact storage. When the work station is in an open position, the work surfaces in forming the expanded working area, overlap slightly in a second overlapping position. The work surfaces are positioned at a height generally accessible by an individual sitting in a chair to permit comfortable working thereon. According to another aspect of the invention, one section of the invention, includes a slot for storing the back support of a chair, the seat being under the work surface, when the work station is in a closed position.

Other advantages and aspects of the present invention will become apparent upon reading the following description of the drawings and the detailed description of the invention.

BRIEF DESCRIPTION OF THE DRAWINGS

To understand the present inventions, it will now be described by way of example, with reference to the accompanying drawings in which:

FIG. 16 is a top plan view of an alternative embodiment of the work station in an open position;

FIG. 17 is a partial left side view of an alternative, hinged work surface; and, FIG. 18 is a further alternative, hinged work surface.

DETAILED DESCRIPTION

Figure 1:
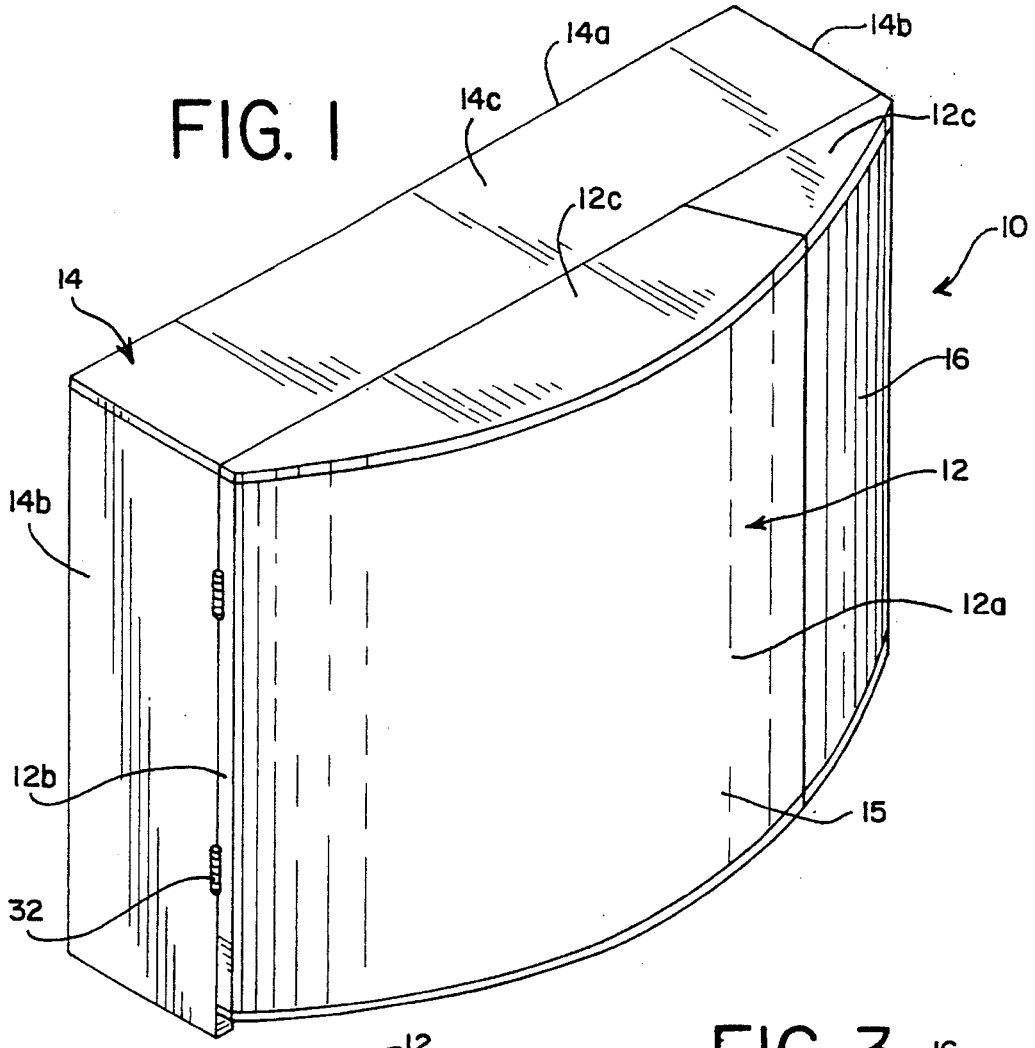
FIG. 1 is a top perspective view of the present invention appearing in a closed position.
Figure 2:
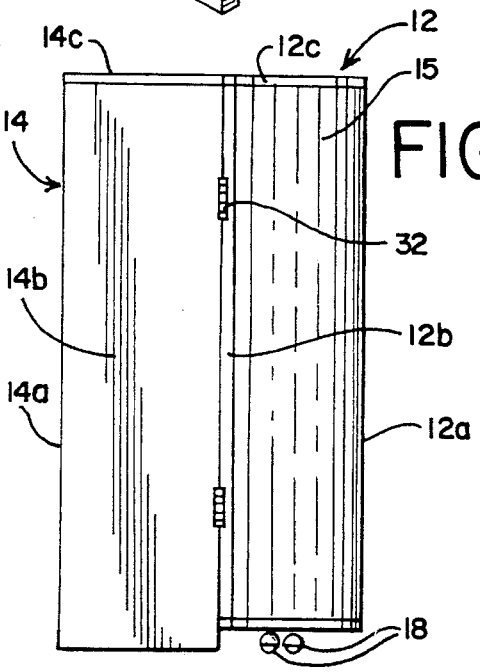
FIG. 2 is a left elevation view of the work station of FIG. 1.
Figure 3:
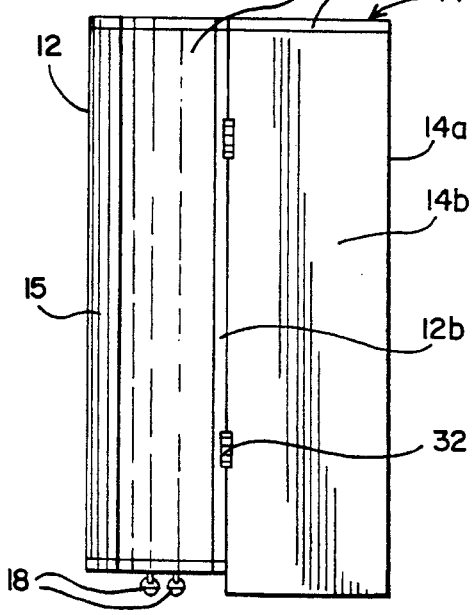
FIG. 3 is a right elevation view of the work station of FIG. 1.

While the invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The work station, generally designated by the reference numeral 10, is shown in FIGS. 1–7 as it would appear in a closed, stored position. FIGS. 8–14 show the station 10 in the open position. The work station is a single, self-standing, self-contained unit having a front section 12 and a rear section 14. The rear section 14 is stationary; it stands firmly on the ground. Disposed within each section are horizontally positioned, inwardly projecting work surfaces and separate storage areas. As a foundation or support structure, the rear section 14 includes a substantially vertical outer wall 14*a*, which acts as a back wall, and two opposed side walls 14*b*. A substantially horizontal top member 14*c* connects the top edges of the back and side walls 14*a*,14*b*, while the bottom edges of the back and side walls contact the ground. As a result, the rear section is similar to a cubicle.

The work station also includes a front section 12, and preferably two front sections, connected to the rear section or base unit 14. The front section 12 is attached by a plurality of hinges 32 to the rear section 14 so as to be pivotably movable about the rear section 14 between an open and a closed position. The hinges 32 connect opposed outer side edges 12*b* (FIGS. 1, 2 and 3) of the front section to the leading front edge of the two opposed side walls 14*b* of the rear section 14. As a support and storage structure, the front section 12 may be any shape including square or rectangular. Preferably, the front section 12 includes a contoured front outer wall 12*a*, giving the front section an arcuate appearance. A contoured top member 12*c* connected to and closely following the contour of the front outer wall 12*a* completes the front section 12.

Figure 4:
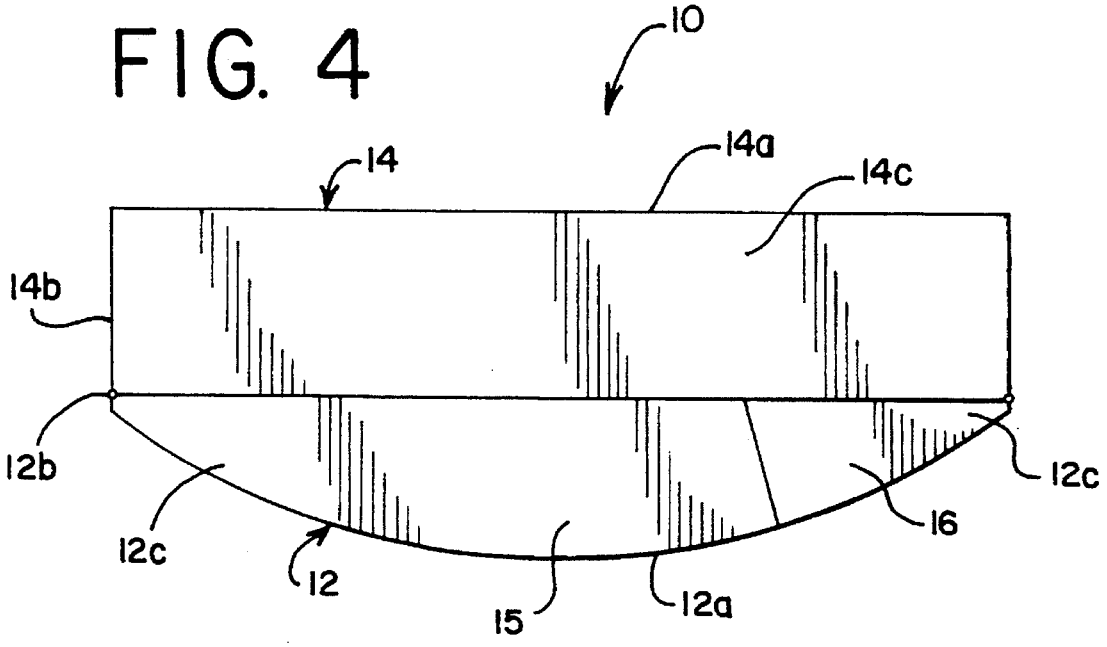
FIG. 4 is a top plan view of the work station appearing in the closed position.
Figure 5:
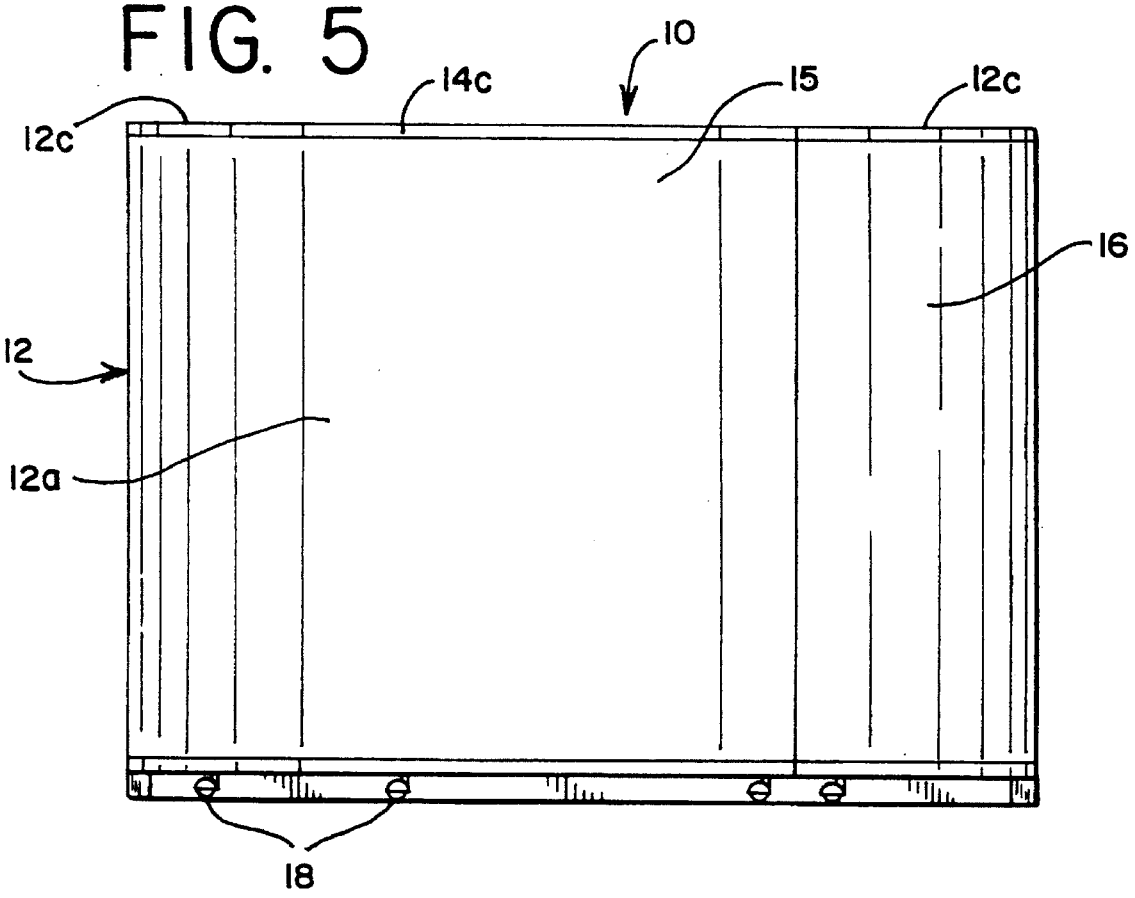
FIG. 5 is a front elevation view of the work station appearing in the closed position.
Figure 6:
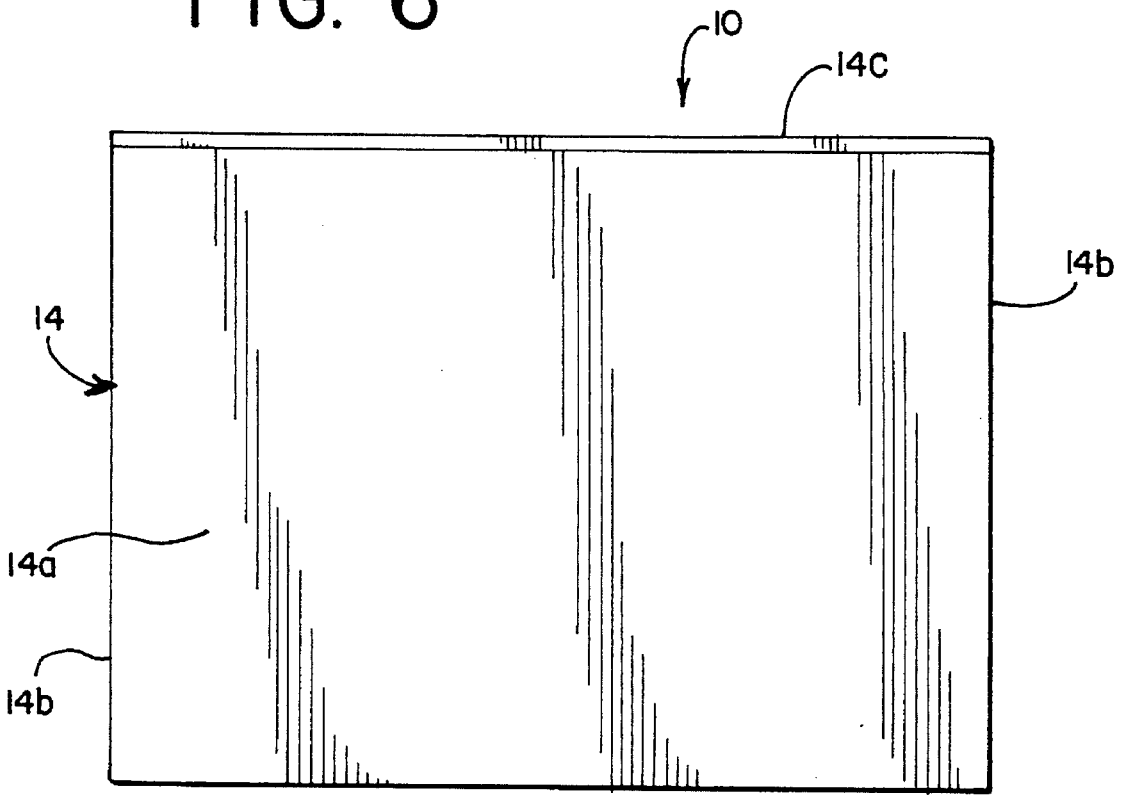
FIG. 6 is a rear elevation view of the work station appearing in the closed position.
Figure 8:
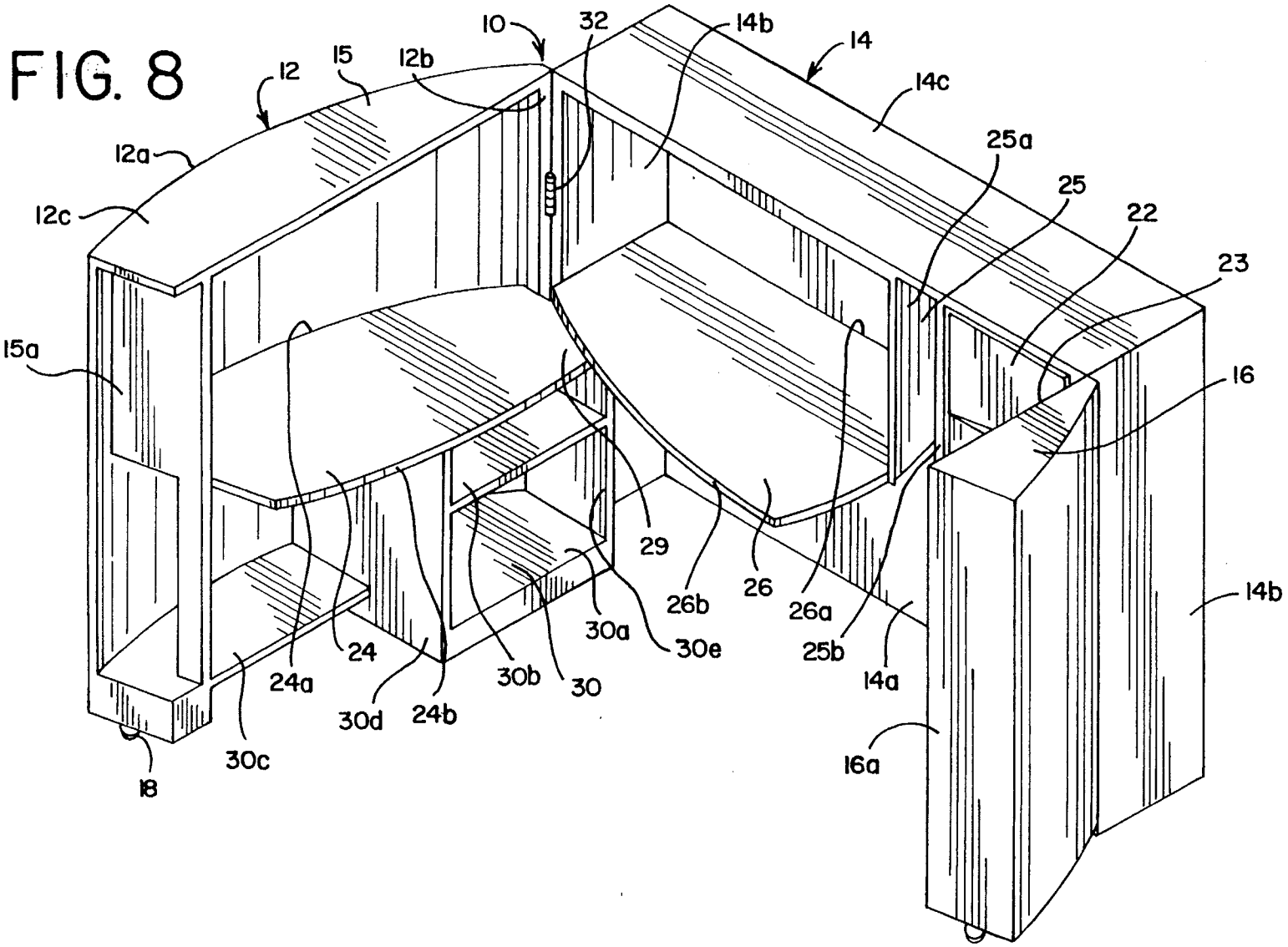
FIG. 8 is a top perspective view of the work station in an open position.
Figure 9:
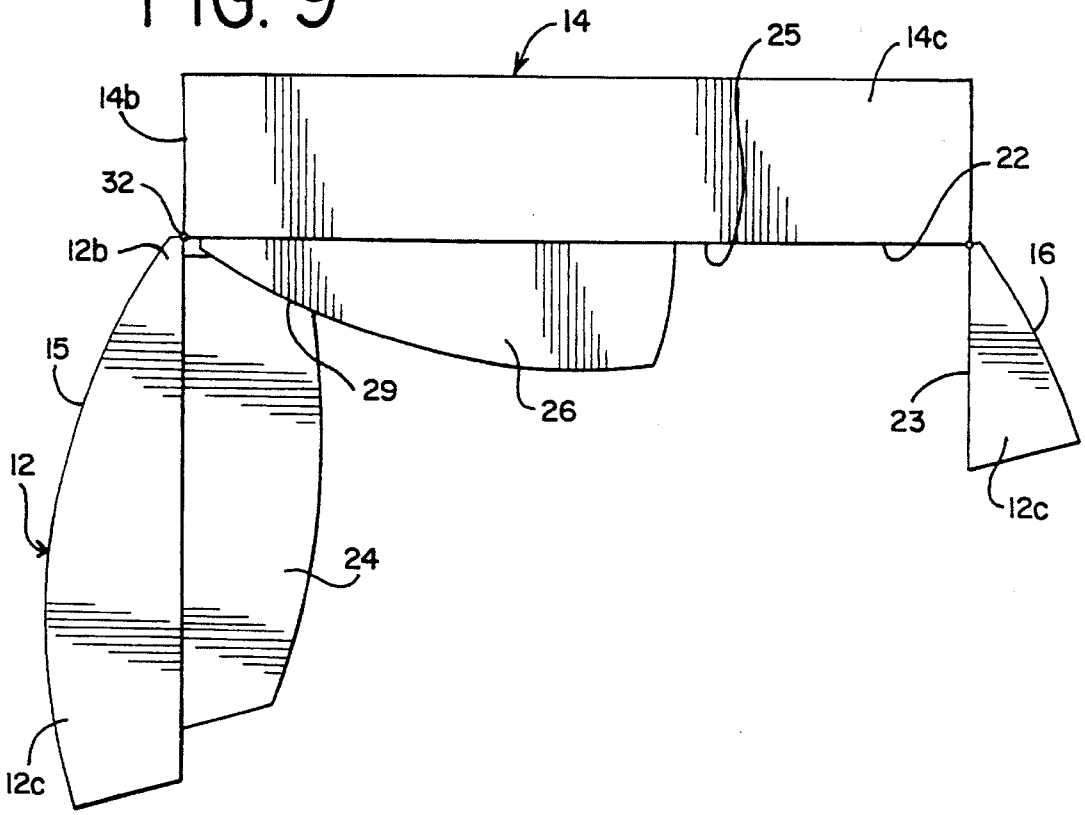
FIG. 9 is a top plan view of the work station in the open position.
Figure 10:
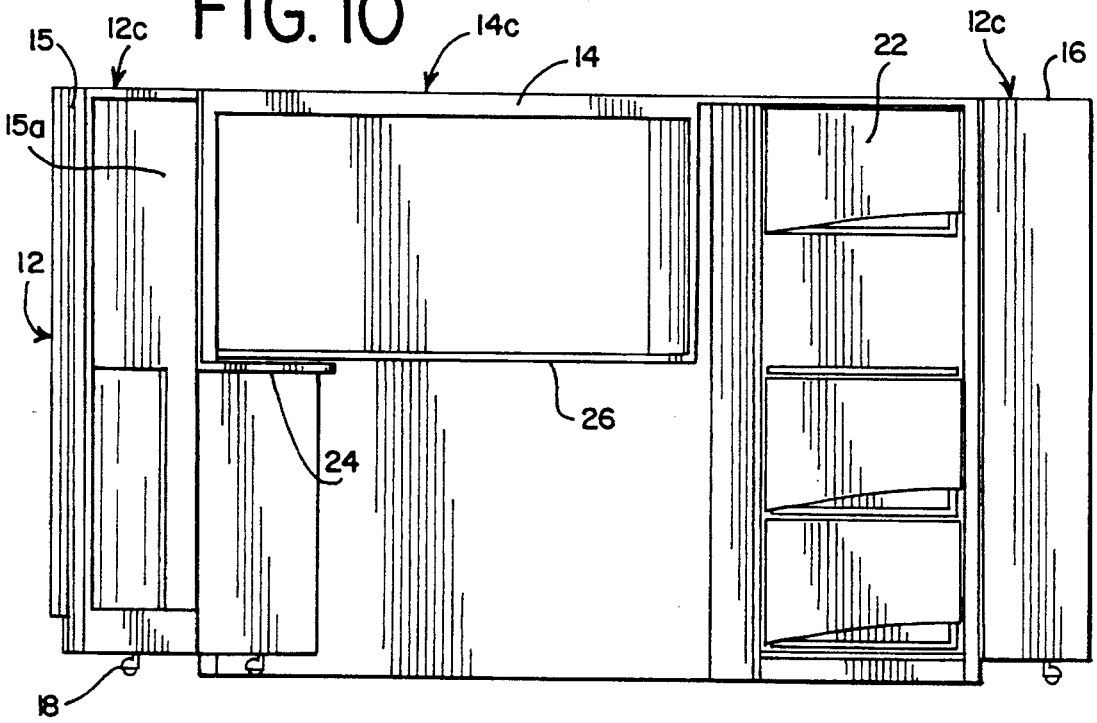
FIG. 10 is a front elevation view of the work station in the open position.
Figure 11:
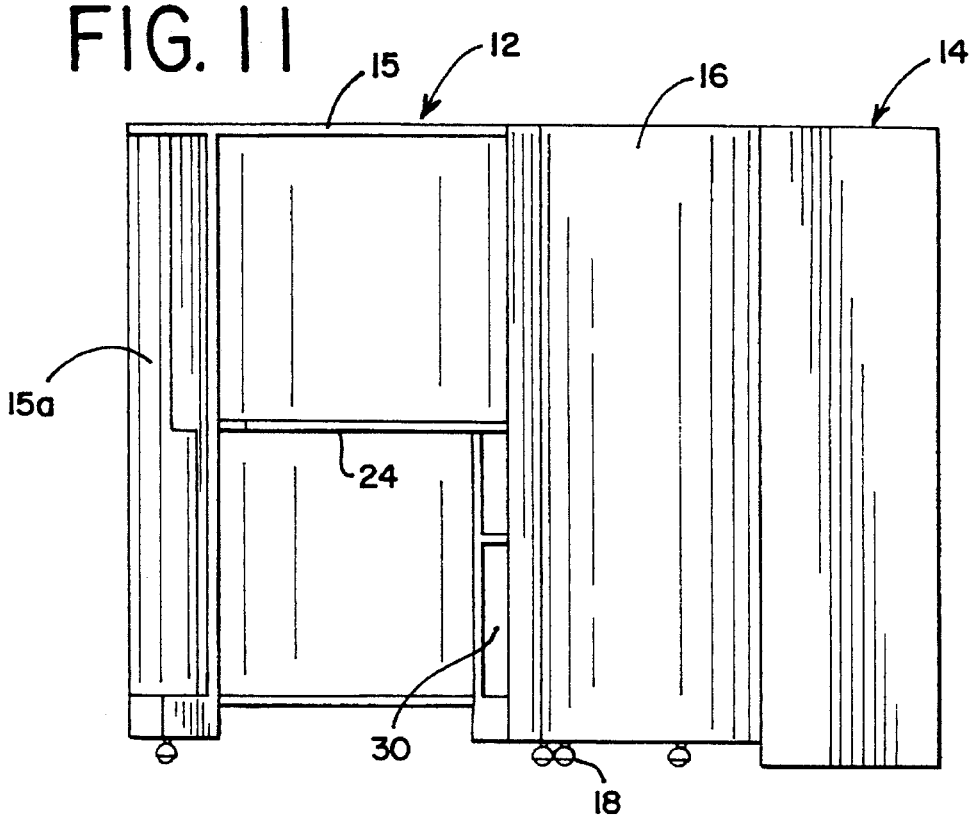
FIG. 11 is a right side elevation view of the work station in the open position.
Figure 12:
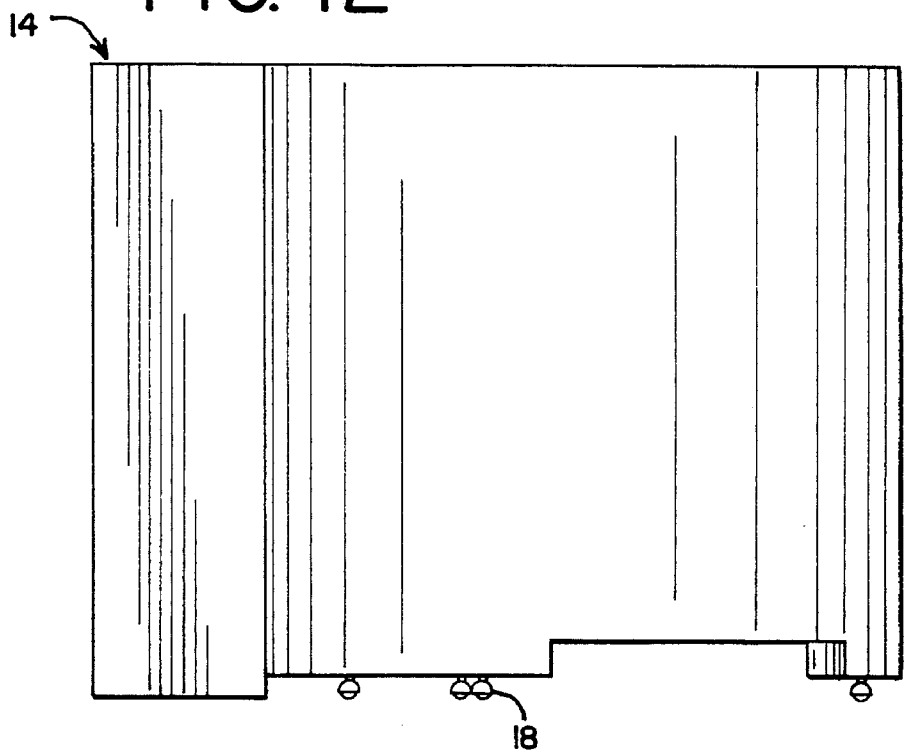
FIG. 12 is a left side elevation view of the work station in the open position.
Figure 13:
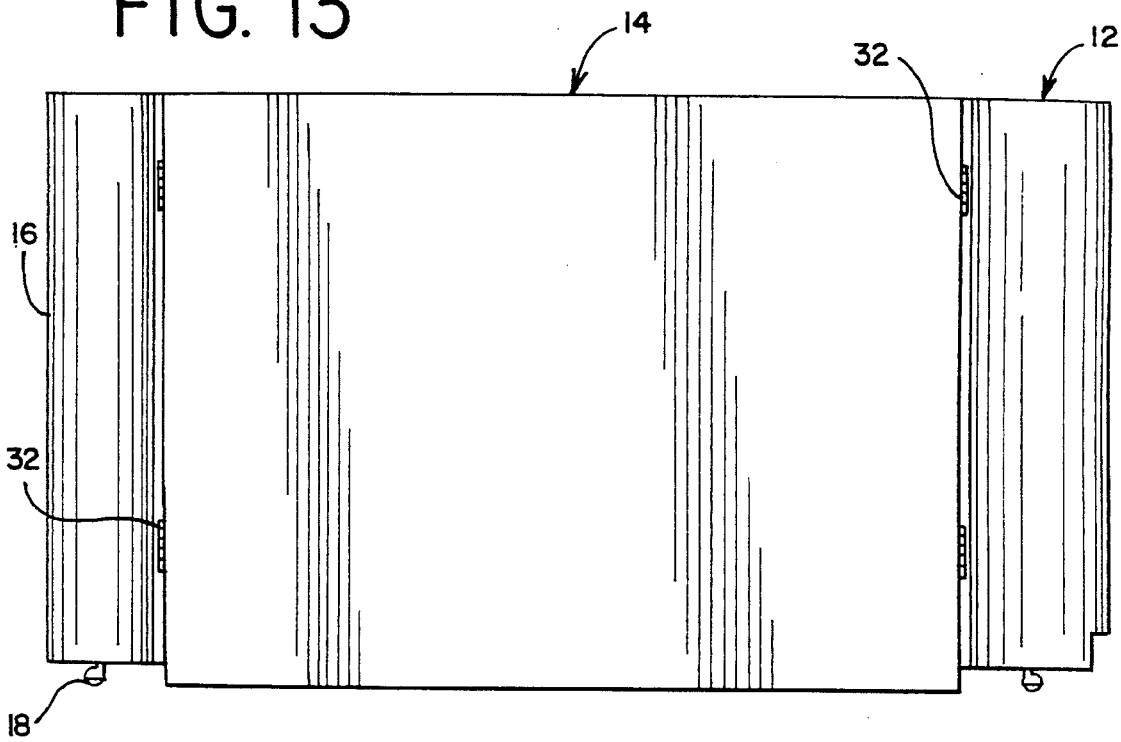
FIG. 13 is a rear elevation view of the work station in the open position.
Figure 14:
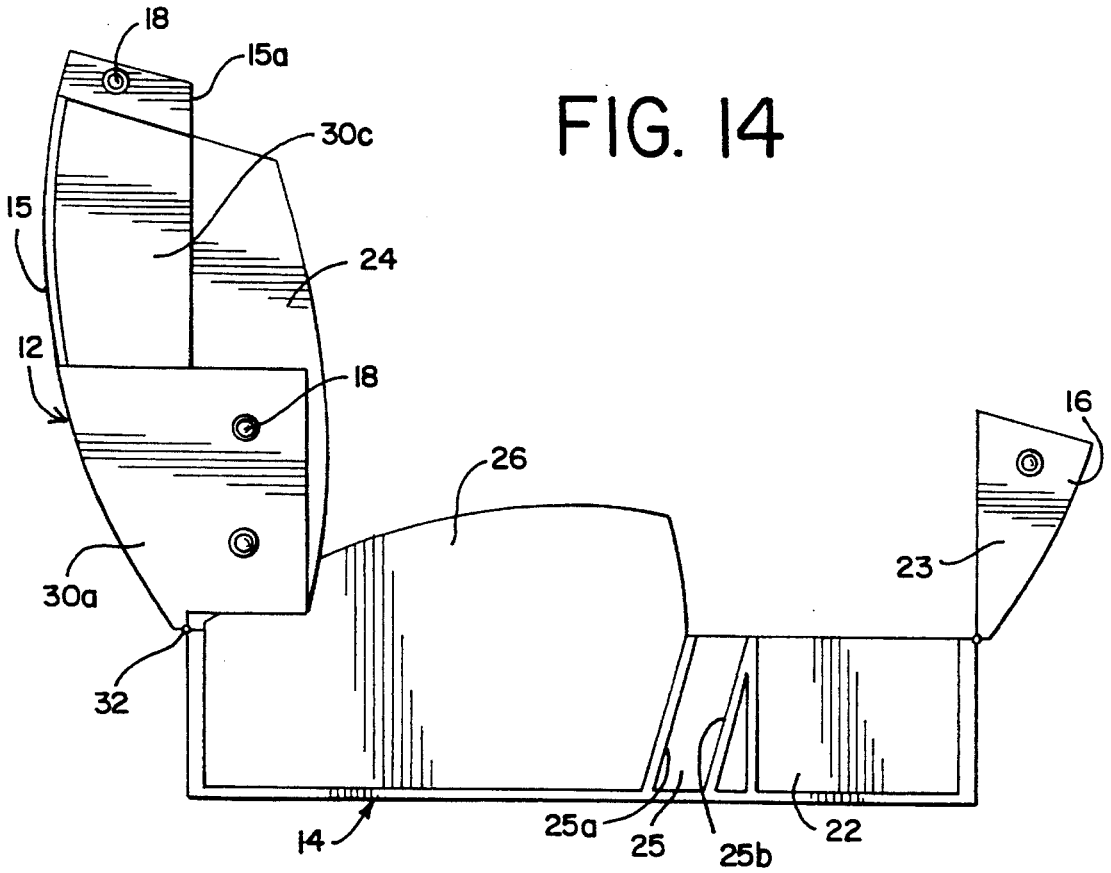
FIG. 14 is a bottom plan view of the work station in the open position.

As shown in FIGS. 1, 4 and 8, the front section 12 further comprises two door units 15,16 which divide the front section into two smaller sections. It has been found that two smaller, lighter weight door units are preferable to a single, large door unit for greater ease in opening and closing the work station 10. The first door unit 15 is approximately twice the size of the second door unit 16. The first door unit 15 includes a recessed inner end opposite the hinged edge 12*b*. The second door unit 16 includes a smooth inner end 16*a* opposite the hinged edge 12*b*. When the unit 10 is in a closed position, the inner end 16*a* of the second door unit 16 meets flush with the inner end 15*a* of the first door unit 15, forming the smooth arcuate appearance of the outer wall 12*a* of the front section 12. Each door unit is pivotally movable, independent of the other door and about a side of the rear section 14 due to the hinges 32. To further assist the door units 15,16 in pivoting about the stationary rear section 14, casters or wheels 18 are attached to the bottom of each door unit 15,16. In addition, casters 18 may be similarly attached to the bottom of the rear section 14 to provide greater ease in mobility of the entire unit. The casters 18 are further provided with a conventional locking device (not shown) to secure the unit in its set up position. Optionally, door handles (not shown) can be positioned on the outer wall of each door unit to further assist in opening and closing the unit.

In one embodiment of the invention shown in FIG. 8, secured within the inside surface of the first door unit 15 of the front section 12, is a first horizontally disposed, expandable work surface 24. The first work surface 24 is secured flush to the inner surfaces of the contoured vertical outer front wall 12*a*, the inner end 15*a*, and the hinged end 12*b*. Similarly disposed in the inner surface of the rear section 14, is a second horizontally disposed, expandable work surface 26. The second work surface 26 is secured flush to the inner surfaces of the vertical outer back wall 14*a*, the side wall 14*b* adjacent the first door unit 15, and a side wall 25*a* of a slot 25, to be discussed later. The work surfaces 24, 26 are secured to their respective sections by a variety of suitable securing methods depending upon the materials used and manufacturer requirements. The outer edge 24*a*,26*a* of the work surfaces conforms to the shape of the vertical outer wall 12*a*,14*a* of each section 12,14 it is attached to. For example, the outer edge 24*a* of the first work surface has a complementary arcuate shape to conform to the vertical outer wall 12*a* of the front section 12. The outer edge 26*a* of the second work surface 26 likewise has a squared-off rectangular shape to conform to the vertical outer wall 14*a* of the rear section 14. The inner, distal edge 24*b*,26*b* of the work surfaces 24,26 projects outwardly from the outer surfaces of the respective sections 12, 14. The distal edge 24*b*,26*b* of both work surfaces 24,26 is slightly arcuate. The distal edge 26*b* of the work surface 26 in the rear section 14 follows the contour of the outer wall 12*a* of the front section 12. Similarly, the distal edge 24*b* of the work surface 24 in the front section 12 follows the contour of the outer wall 14*a* of the rear section 14. The arcuate shape of the distal edges 24*b*,26*b* is preferred because when the work surfaces 24,26 are in their expanded open position, the shape of both work surfaces together provides a surface area greater than either of the work surfaces individually. The work surfaces 24,26 provide sufficient surface area for accommodating a computer, a fax machine and a telephone, while providing enough desk space for working comfortably thereon. Also, the arcuate shape of the work surfaces 24, 26 enables the work surfaces to be stored completely within the work station 10 when the work station is in a closed position. The work surfaces 24,26 can be permanently or removably secured or adjustable through conventional means. However, regardless of attachment, the work surfaces 24,26 are positioned at a height accessible comfortably by an individual sitting in the chair.

Figure 7:
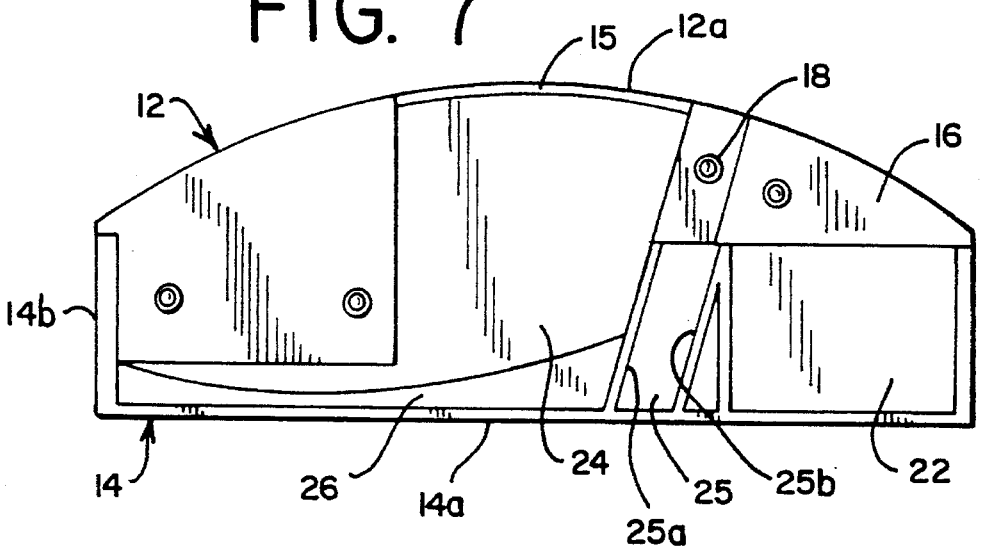
FIG. 7 is a bottom plan view of the work station appearing in the closed position.

When the work station 10 is in a closed, stored position, the work surfaces 24,26 are arranged parallel and slightly spaced apart from one another so the surfaces completely overlap one another in a first overlapping position, but without coming in contact with one another, possibly damaging the surfaces (FIG. 7). Additionally, as described earlier, the complimentarily contouring of the distal edges of the work surfaces, ensures that relatively large work surfaces can be incorporated and stored into the work station.

In an alternative embodiment of the invention, the front section 12, rather than having an arcuate front portion, has a square or rectangular front. The work surfaces 24,26 are horizontally disposed and secured within the front section 12 and the rear section 14, as previously described. In addition, the work surfaces 24,26 maintain their arcuate distal edges 24*b*,26*b* to maximize the work space available. In this embodiment, shown in FIGS. 16–18, each work surface 24,26 is divided into two separate sections, a movable pivoting distal section 24*c*,26*c* and an inner secured section 24*d*,26*d*. The pivoting distal section 24*c*,26*c* is hingedly attached to the inner secured section 24*d*,26*d* permitting the distal section to be placed in a position upright and perpendicular to the secured section or parallel and on top of the secured section when the work station 10 is in a closed, stored position. In the figures shown, the distal section 24*c* of the first work surface 24 attaches at a point on the outer edge of secured section 24*d* so that when the distal section is in the upright stored position, the distal section is recessed approximately half way into the interior of the front section 12. The distal section 26*c* of the second work surface 26 is attached to the outer edge of the secured section 26*d* so that when the distal section is in a stored position, the top surface of the distal section aligns with the leading front edges of the rear section, essentially forming an enclosure of the rear section. The positioning of the stored work surfaces 24,26 permits positioning of a chair 34 with the back portion or back support 34*a* of the chair flush to the upright distal section 26*c* and the seat portion 34*b* located under the horizontal secured section 26*d* of the work surface 26. The recessed first work surface 24 also accommodates the back portion 34*a* of the chair 34. In this position, the chair can be stored within the work station 10 when the work station is in a closed position.

Holes may be provided in the work surfaces to permit wires and cords to pass therethrough. Additionally, lights may be secured to the work surfaces, on walls adjacent the work surfaces and on the top surfaces above the work surfaces.

When the work station 10 is moved outwardly into an open, accessible position, the first door unit 15 and the second door unit 16 are pivotally movable about the sides of the rear section 14, and thus can be opened into any desired position. The first work surface 24 moves with the first door unit 15, outwardly and away from the stationary second work surface 26 of the rear section 14. Preferably, the first door unit 15 is positioned at about a ninety degree angle from the rear section 14, likewise positioning the first work surface 24 at a ninety degree angle to the second work surface 26. In this position, the greatest amount of surface area of the two work surfaces 24,26 is exposed. As again shown in FIG. 8, when the work station 10 is in the open position, the first work surface 24 and the adjacent second work surface 26 overlap (second overlapping area 29). The second overlapping area 29 is a relatively small section adjacent to the hinged edges 12*b*,14*b* of the front and rear sections 12, 14, respectively. The small overlapping area 29 minimizes the loss of work space while maintaining an overall compact, organized appearance.

Figure 15:
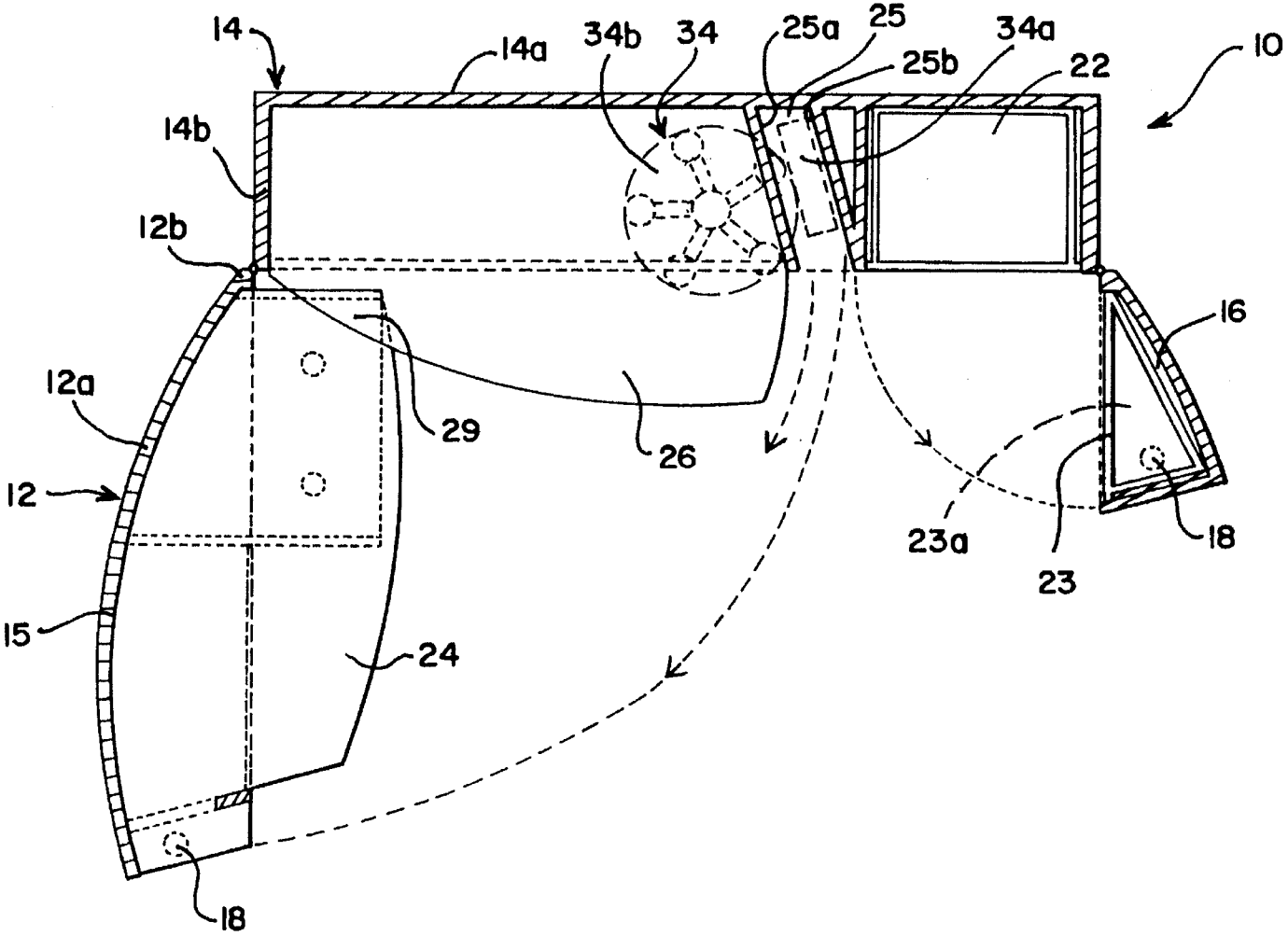
FIG. 15 is a top sectional view of the work station in the open position.

In a preferred embodiment of the invention, the rear section 14 further includes a slot 25 located between and adjacent to the second work surface 26 and a storage area 22; this slot 25 is formed by two parallel side walls 25*a*,25*b*. The first side wall 25*a* has a length from attachment to the top member 14*c* of the rear section 14 to the bottom of the edge of the second work surface. This first side wall 25*a* functions as a support for attachment of the second work surface 26. The second side wall 25*b* has a length from the top member 14*c* of the rear section 14 to the ground, and forms a storage area 22. As shown in FIG. 15, the slot 25 is large enough to accommodate the back portion or back support 34*a* of a chair 34. The chair 34 can be stored completely within the work station 10, the seat portion 34*b* being generally located under the work surface 26, when the work station 10 is in a closed position. Similarly, the chair 34 is easily accessible and removable from the slot 25 in the work station 10 when the work station is in an open position.

In addition to the work surfaces 24, 26, storage areas 22 (FIG. 10) and 23 (FIGS. 15) for files and supplies are provided, Specifically, located inside the rear section 14, is a storage area 22 for shelves and the like, but preferably designed to accommodate file cabinets. The storage area 22 is formed by the back vertical wall 14*a*, the side wall 14*b* adjacent the smaller door unit 16, the horizontal top member 14*c* and the second and longer of the parallel side walls 25*b* forming the adjacent slot 25. The slot 25 separates the storage area 22 from the second work surface 26.

A second storage area 23 is located within the second door unit 16. The second door unit 16, having generally a wedge shape, has a smaller size than the first door unit, and is designed primarily as a storage area for both pull-out and stationary shelves 23*a* (FIG. 15), cabinets or drawers.

Additional shelving 30*a*, 30*b*, 30*c* and partitions or supports 30*d*, 30*e* (FIG. 8) may be included for further storage space, foot rests, printers, paper and other office related materials.

The work station 10 is ideally designed to be a complete office unit, having spaces to accommodate typical office equipment, such as a computer and printer, fax machine and telephone. Consequently, the work station 10 should include a source of power for the equipment. For example, the work station may be internally wired to receive electricity, including outlets within the walls of the sections 12,14. Small cutouts may also be provided in the walls of the front and rear sections 12,14, just large enough to accommodate electrical or telephone wires. Optionally, as noted previously, the work station 10 may further include sources of lighting, such as recessed lighting preferably positioned over or adjacent the work surfaces.

The work station 10 can be constructed from a variety of materials such as those typically used in furniture construction including solid woods, laminates, metals and plastics. In addition, the entire workstation is lockable through conventional locking means.

While specific embodiments have been illustrated and described, numerous modifications are possible without departing from the spirit of the invention, and the scope of protection is only limited by the scope of the accompanying claims.

We claim:

1. A work station comprising at least two front sections and a rear section with each section having opposed sidewalls and a top wall, one side wall of each front section being hingedly attached to a side wall of the rear section, and the front sections being movable about hinged attachments between an open position and a closed position, each section further having an outer wall, one front section and the rear section having inwardly projecting substantially flat work surfaces inside the sections, each work surface having portions extending beyond and outward from the side walls and the top wall, the work surfaces being adapted for fitting entirely within the work station, the portions of the work surfaces extending beyond and outward from the sidewalls and the top wall of one section and projecting into the other section when the one front section is in the closed position and for cooperating with one another to form an expanded working surface and overlapping portions when the one front section is in the open position, the expanded work surface having a surface area greater than either of the work surfaces alone.

2. The work station as defined in claim 1 wherein the work surfaces are substantially horizontal and disposed parallel to and spaced from one another and have a first overlapping area when the one section is in the closed position and a second overlapping area when the one section is in the open position, the first overlapping area being substantially greater than the second overlapping area.

3. The work station as defined in claim 2 wherein a distal edge of the work surface of one of the sections is generally arcuate generally following a contour of the outer wall of the other section when the one section is in the closed position.

4. The work station as defined in claim 2 wherein the outer wall of one of the sections is contoured and a distal end of the work surface of the other section is spaced from and generally follows the contour of the outer wall of the one section when the one section is in the closed position.

5. The work station as defined in claim 2 wherein the front section is a door unit and the rear section is a base unit and the two units are hingedly attached to one another such that the door unit pivots about the base unit.

6. The work station as defined in claim 5 wherein the work surfaces are positioned at a height generally accessible by an individual sitting in a chair permitting comfortable working thereon.

7. The work station as defined in claim 5 wherein the base unit and the door unit cooperate together in a closed position to form a single, freestanding unit.

8. A work station comprising at least two front sections and a rear section with each section having opposed side walls and a top wall, one side wall of each front section being hingedly attached to a side wall of the rear section, and the front sections being movable about hinged attachments between an open position and a closed position, each section further having an outer substantially vertical wall, one front section and the rear section having inwardly projecting substantially flat work surfaces inside the sections, each work surface having portions extending beyond and outward from the side walls and the top wall, the work surfaces being substantially horizontal, positioned at a height generally accessible by an individual sitting in a chair permitting comfortable working thereon and disposed parallel to and spaced from one another and being adapted for fitting entirely within the work station, the portions of the work surfaces extending beyond and outward from the side walls and the top wall of one section and projecting into the other section and forming a first overlapping area when the one section is in the closed position and for cooperating with one another to form an expanded work surface having a second overlapping area when the one section is in the open position, the expanded work surface being greater than either of the work surfaces alone and the first overlapping area being substantially greater than the second overlapping area.

9. The work station as defined in claim 8 wherein the vertical wall of the front section is contoured and a distal end of the work surface of the rear section is spaced from and generally follows a contour of the vertical wall of the front section when the front section is in the closed position.

10. The work station as defined in claim 9 wherein the front section has wheels or casters thereon and the two sections are hingedly attached to one another such that the front section pivots relative to the rear section and further cooperate together in a closed position to form a single, freestanding station.

11. The work station as defined in claim 9 wherein the front section has wheels or casters thereon and is hingedly attached to a side of the rear section and a second front section with wheels or casters thereon is hingedly attached to an opposed side of the rear section, the front section and second front section pivoting relative to the rear section cooperating to form a single, freestanding station when the sections are in the closed position.

12. A work station comprising:

at least a front section and a rear section with one section being movable relative to the other section between an open position and a closed position;

a chair;

a substantially horizontal work surface connected to either section and positioned at a height generally accessible by an individual sitting in the chair permitting comfortable working thereon;

means for housing the chair within the work station such that the chair fits entirely within the work station when the one section is in the closed position and is easily accessible and removable from the work station when the one section is in the open position.

13. The work station as defined in claim 12 wherein the chair includes a seat portion and a back portion and the means for housing the chair is a slot positioned adjacent the work surface sized to permit the back portion of the chair to slide in and out of the slot, the seat portion fitting below the work surface.

14. The work station as defined in claim 13 wherein each section has a vertical wall and an inwardly projecting substantially horizontal work surface disposed parallel to and spaced from the other work surface in the other section and adapted for fitting entirely within the work station and having a first overlapping area when the one section is in the closed position and cooperating with one another to form an expanded work surface having a second overlapping area and an expanded working area when the one section is in the open position such that the expanded working area is greater than either work surfaces alone and the first overlapping area is substantially greater than the second overlapping area.

15. The work station as defined in claim 14 wherein the vertical wall of the front section is contoured and a distal end of the work surface of the rear section is spaced from and generally follows the contour of the vertical wall of the front section when the front section is in the closed position.

16. The work station as defined in claim 15 wherein the front section has wheels or casters thereon and is hingedly attached to a side of the rear section and a second front section with wheels or casters thereon is hingedly attached to an opposed side of the rear section, the front section and second front section pivoting relative to the rear section cooperating to form a single, freestanding station when the sections are in the closed position.

* * * * *